United States Patent [19]

Kessler et al.

[11] Patent Number: 4,723,419

[45] Date of Patent: Feb. 9, 1988

[54] OUTDOOR HEAT EXCHANGER SECTION

[75] Inventors: Alan F. Kessler, Tyler, Tex.; William A. Smiley, III, Stoddard, Wis.; Michael E. Wendt, Flint, Tex.

[73] Assignee: American Standard Inc., New York, N.Y.

[21] Appl. No.: 894,178

[22] Filed: Aug. 7, 1986

[51] Int. Cl.[4] ..... F25B 39/04

[52] U.S. Cl. ..... 62/507; 165/145

[58] Field of Search ..... 62/507, 508, 298, 428; 165/122, 145

[56] References Cited

U.S. PATENT DOCUMENTS

| | | | |
|---|---|---|---|
| 2,920,464 | 1/1960 | Trask | 62/507 |
| 3,759,321 | 9/1973 | Ares | 165/125 |
| 3,827,483 | 8/1974 | Hopkinson | 62/507 |
| 4,036,292 | 7/1977 | Hine, Jr. | 165/122 |
| 4,307,778 | 12/1981 | Tobin et al. | 165/125 |

*Primary Examiner*—Henry A. Bennet

*Attorney, Agent, or Firm*—William J. Beres; David L. Polsley; Robert J. Harter

[57] ABSTRACT

An outdoor heat exchanger section has lower and upper cabinet sections between which a generally horizontal louvered lower section top cover is disposed. The sides of the lower cabinet section are louvered to promote the entry and upward movement of air thereinto and through a heat exchange coil disposed about the inner periphery thereof. Air drawn into the lower cabinet section is discharged though the radially louvered portion of the lower section top cover. The radial top cover louvers are angled so as to partially deflect the upwardly flowing air leaving the lower cabinet section to the horizontal. The top of the upper cabinet section is essentially flat and solid and overlies the lower cabinet section top cover louvers so that neither debris nor the elements can enter the lower cabinet section from above. The sides of the upper cabinet section are angled and include louvers which are themselves angled, both of which features cooperate to efficiently direct air out of the upper cabinet section in a direction which is upward and away from the lower cabinet section. The upper cabinet section includes a stator which provides support for the upper cabinet section top and which assists in the efficient direction of air to and out of the upper cabinet section sides.

17 Claims, 6 Drawing Figures

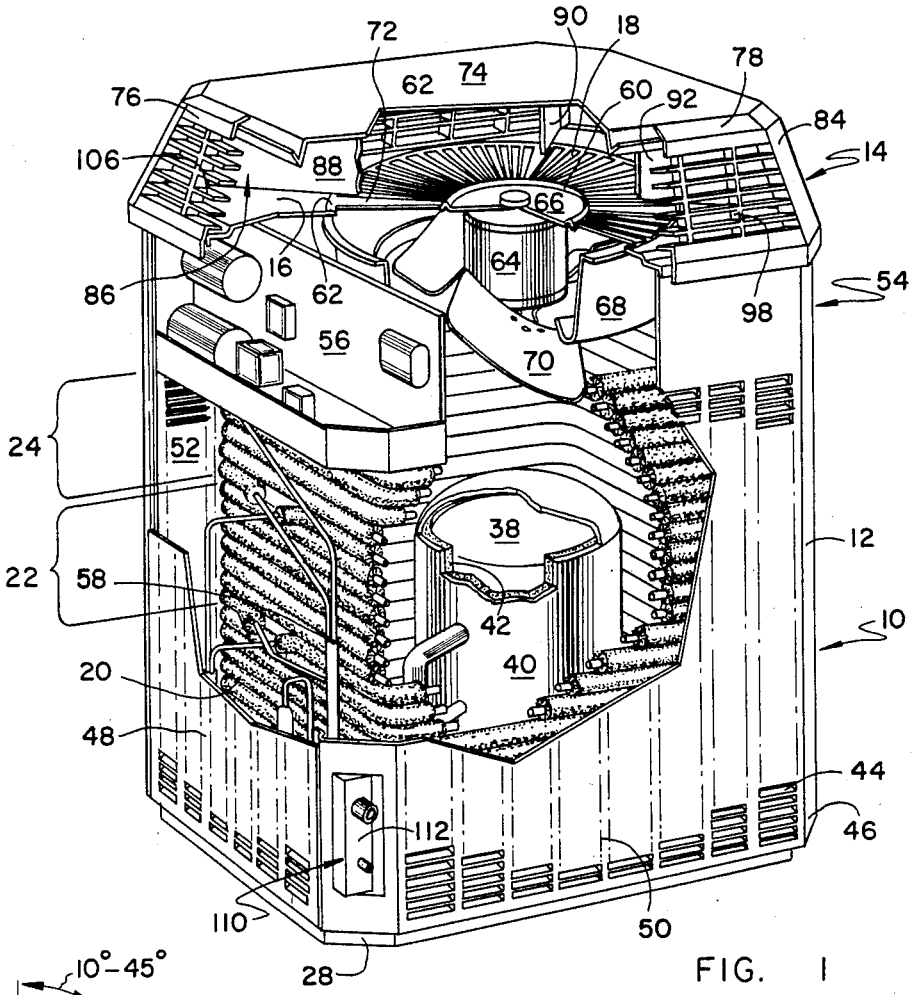
FIG. 1
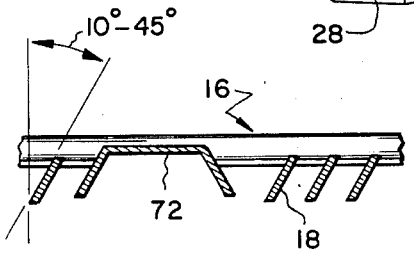
FIG. 5
FIG. 2
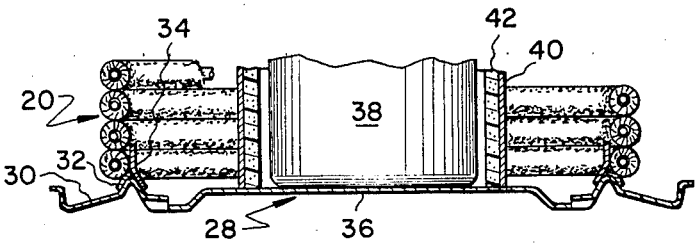

OUTDOOR HEAT EXCHANGER SECTION

FIELD OF THE INVENTION

The present invention relates to an outdoor section for a refrigeration system such as dedicated air conditioner or a heat pump.

BACKGROUND OF THE INVENTION

"Split" air conditioning systems are those systems in which a first heat exchanger is located indoors while a second heat exchanger is located outdoors. The heat exchangers are connected in series with refrigerant traveling from a compressor, which is typically located outdoors, to either the indoor or the outdoor heat exchanger. In a dedicated air conditioning application refrigerant flows from the compressor to the outdoor heat exchanger coil, which functions as a condenser, and then indoors to the heat exchanger coil which functions as an evaporator.

In a heat pump circuit the refrigerant flows from the compressor to the one of the outdoor and indoor heat exchanger coils that operates as a condenser which, in turn, depends upon the mode of circuit operation. In any case, the performance of any split air conditioning or heat pump system is significantly affected by the flow of air through and over the system's outdoor heat exchanger.

The outdoor heat exchanger in a split system is typically enclosed in a cabinet which also houses (1) refrigeration system controls, (2) a refrigerant compressor, (3) refrigerant plumbing, and (4) a fan. The cabinet must afford protection for the components it houses from debris and the elements while allowing for sufficient airflow to promote the efficient transfer of heat between the refrigerant flowing through the outdoor heat exchanger and outdoor air. Such heat exchange is critical since in both indoor space heating and indoor space cooling operations outdoor air is the heat source or heat sink upon which system operation relies.

The design of outdoor heat exchanger cabinets has historically been a tradeoff between airflow and component protection considerations, among other things. Other considerations are component accessibility for maintenance and/or repair, cabinet drainage, noise quieting, cabinet appearance, air discharge direction and ease of fabrication.

Air conditioning outdoor sections most commonly draw air over the heat exchanger housed therein through the sides or periphery of their cabinets. Such air, after passing through the heat exchanger, is typically discharged upward and away from the cabinet through the cabinet top. One very significant reason for discharging the air upward to a location remote from the location where air is drawn into the heat exchanger is to prevent the mixing of air which has just traveled through the heat exchanger with air being initially drawn into the heat exchanger. If such mixing is allowed to occur the heat exchange efficiency of the outdoor heat exchanger is significantly reduced. Typical of this configuration are the outdoor heat exchanger cabinets illustrated in U.S. Pat. Nos. 4,036,292 and 4,307,778. A disadvantage of this type of outdoor section configuration is the exposure of the components interior of the cabinet to debris such as twigs and leaves which can fall into the cabinet between the louvers of the cabinet top. Such cabinets also directly expose the components interior thereof to hail, rain, sleet and snow. If the louvers are spaced too far apart, the ability of debris to fall into the cabinet increases while if the louvers are too close, airflow efficiency suffers.

A different outdoor cabinet configuration is found in U.S. Pat. No. 3,759,321 in which air is both drawn into and discharged from the sides of an outdoor cabinet. While this design is somewhat protective of the components interior of it, it is conducive to the recirculation of discharged air with air being drawn into the cabinet because of the proximate locations of air entry into and discharge from the cabinet. As noted above, such recirculation diminishes the efficiency of the heat exchange process significantly. Further, the horizontal direction of air discharge is disadvantageous from the standpoint that air conditioning outdoor units are generally located at the side of a residence or building in a landscaped area. The velocity and volume of air discharged from an outdoor cabinet is typically significant and can damage bushes, flowers and the like in the near vicinity of the cabinet.

SUMMARY OF THE INVENTION

It is a primary object of the present invention to provide an outdoor air conditioning section which provides for efficient airflow therethrough to enhance heat exchange efficiency while simultaneously providing protection for the components internal of the cabinet from debris and the elements.

It is a further object of this invention to provide an air conditioning outdoor section which provides easy access to its interior and the components therein for maintenance and repair purposes.

It is another object of the present invention to provide an air conditioning outdoor section which provides efficient airflow therethrough, including the upwardly directed discharge of air, while having an essentially flat/solid protective top.

The objects of the present invention are accomplished by an air conditioning outdoor section having lower and upper cabinet sections. The upper cabinet section efficiently directs the discharge of air upward and away from the cabinet while providing a solid cover which protects the cabinet components from debris and inclement weather conditions.

Air is drawn into the interior of the lower cabinet section through louvered sides which shield the heat exchanger therein from the environment. A fan draws air through the cabinet sides and through the heat exchanger, discharging the air upwardly through a horizontal louvered top cover piece which separates the lower and upper cabinet sections. The louvers in the top cover deflect and direct the air discharged from the lower cabinet section into the interior of the upper cabinet section. The top of the upper cabinet section is flat and solid and overlies the louvers in the horizontal top cover piece, Interior of the upper cabinet section is a stator which serves to further direct and deflect the air discharged from the lower cabinet section to louvers located in the sides of the upper cabinet section. The louvers in the upper cabinet section sides are angled, as are the upper cabinet section sides themselves, for the purpose of directing discharge air upwardly and away from the remainder of the cabinet.

The heat exchanger is a wound coil and is mounted within the cabinet so that the refrigerant plumbing connections and system controls are accessible by the removal of a single access panel. The access panel is itself a louvered cabinet side which allows air to be drawn into the cabinet and across the heat exchanger coil around the entire periphery of the lower cabinet section. The outdoor section includes a base pad which supports the heat exchanger coil while providing a condensate run-off surface which promotes the flow of water draining off the heat exchanger coil out of the lower cabinet section.

BRIEF DESCRIPTION OF THE DRAWINGS

FIG. 1 is a perspective cutaway view of the outdoor heat exchanger of the present invention.

FIG. 2 is a cross section of the base pad of the outdoor section.

FIG. 5 is a cross-sectional view taken along line 5—5 in FIG. 4.

DESCRIPTION OF THE PREFERRED EMBODIMENT

Figure 3:
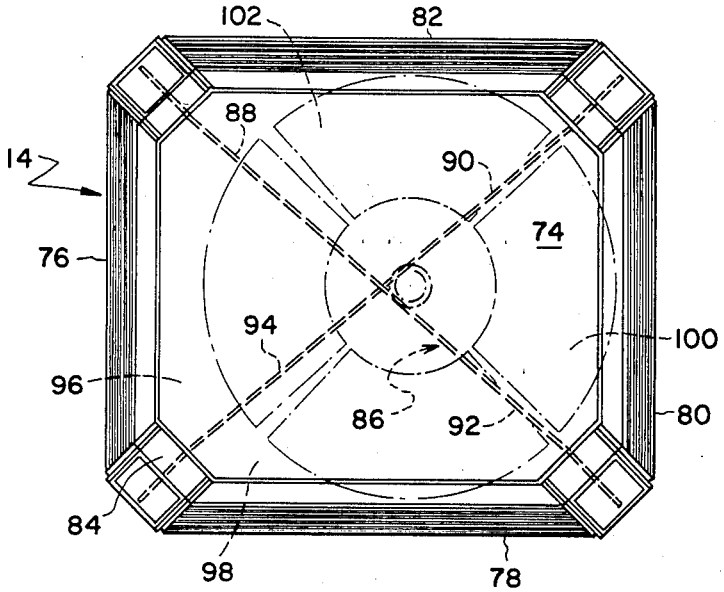
FIG. 3 is a top view of the outdoor section.
Figure 4:
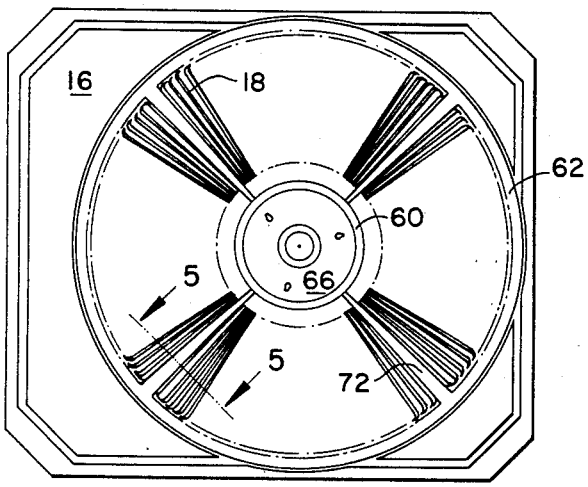
FIG. 4 is a top view of the lower cabinet section top cover, i.e., a top view of the outdoor section of the present invention with the upper cabinet section removed.

Referring to all of the drawing figures concurrently, air conditioning outdoor section 10 is generally divisible into a lower cabinet section 12 and an upper cabinet section 14. Intermediate the upper and lower cabinet sections is a generally horizontal lower cabinet section top cover 16 which defines a plurality of radially oriented louvers 18.

Disposed within lower section 12 is a wound heat exchanger coil 20 which is comprised of one or more individual refrigerant circuits, such as circuits 22 and 24. The heat exchanger coil is preferably a fin and tube heat exchanger of the type in which a spine-type fin material is wrapped around a tube. Referring now primarily to FIGS. 1 and 2, heat exchanger coil 20 is supported by a base pad 28 which includes a condensate run-off surface 30 and other holes/slots/openings which are not shown but which also provide for the egress of water from the outdoor cabinet. A plastic spacer 32 is disposed between heat exchanger coil 20 and base pad 28 to position the coil on the pad and to provide a corrosion barrier by preventing the direct contact of the heat exchanger coil with the base pad. Additionally, brackets 34 position the heat exchanger coil on the base pad thereby facilitating the assembly of the unit. Base pad 28 also provides a mounting surface 36 on which compressor 38 is mounted. Compressor 38 may be disposed within a noise attenuating sound shield 40 which is itself mounted on the base pad. Sound shield 40 preferably includes a sound attenuating material 42 attached to its inner surface.

Each of the sides of lower cabinet section 12 define a plurality of side louvers 44 through which air flows into the interior of the lower cabinet section when the outdoor heat exchange section is in operation. Side louvers 44 are upward opening and are preferably angled from the vertical at an angle of about 45 degrees. Because side louvers 44 are closed at their bottom and are upward opening, each side of lower cabinet section 12 presents an essentially solid barrier to the entry of foreign matter into the lower cabinet section from its periphery. Heat exchanger coil 20, as well as other components located in the lower cabinet section, are therefore protected from the peripheral impingement of foreign matter or debris. Further, the louvers impart a vertical velocity vector to the air which is drawn into the cabinet sides in an essentially horizontal manner.

Lower cabinet section 12 is preferably rectangular and has beveled corner portions 46. The sides of lower cabinet section 12 are preferably formed by the cooperation and attachment of four discrete louvered side panels 48, 50, 52 and 54. One of the side panels, in this case side panel 48, as is illustrated in the figures, is removable to give access to a weather-protected control compartment 56 and the bulk of the refrigerant plumbing connections within the cabinet one of which, 58, is typical. When access panel 48 is in place, control compartment 56 is shielded by the solid upper portion of the access panel. By bending the ends of selected side panels to result in beveled corner portions 46, enhanced cabinet rigidity and column strength is achieved, eliminating the necessity for additional internal cabinet framework. Edges 46 are preferably beveled at an angle of 45 degrees with respect to the louvered faces of the cabinet sides. Access panel 48 is preferably a flat panel, that is, none of its sides are those which are bent to form a beveled corner section.

Top cover 16 is disposed on top of louvered side panels 48, 50, 52 and 54. Concentric raised ring portions 60 and 62 provide strength and stress relief in the preferably unitary top cover piece. Fan motor 64 is attached to and supported within the portion 66 of top cover 16 which is defined interior of inner raised ring 60. An orifice 68, which is preferably "U" or "J" shaped in cross section, is attached to top cover 16 and circumscribes the area in which the blades of fan 70 are disposed. Orifice 68 provides for enhanced airflow through the cabinet and decreases airflow noise within the cabinet.

Referring primarily now to FIGS. 3 through 6, the louvers 18 of the lower cabinet section top cover 16 are radially oriented about ring 60 and each louver is preferably angled in its entirety with respect to the generally horizontal plane of top cover 16 as is illustrated best in FIG. 5. Louvers 18 are angled from the vertical at an angle of from 10 to 45 degrees as is also best illustrated in FIG. 5. However, increased airflow efficiency will be obtained if the angle of louvers 18 is in the range of from 15 through 35 degrees inclusive. The angled louvering of top cover 16 causes the deflection of air discharged from the lower cabinet section so that the upwardly discharged air is also imparted a horizontal velocity vector.

Radial ribs 72 are disposed and fabricated amongst louvers 18 to provide for further stiffness and strength in top cover 16. Additionally, ribs 72, which are essentially inverted "U" shaped sections, provide a convenient and protected location wherein to run wires from fan motor 64 to control compartment 56. In the preferred embodiment a tube, which provides a wire run, is provided underneath one of ribs 72 and is trapped and supported between an accomodating cutout in orifice 68 and the underside of top cover 16.

Upper cabinet section 14 of outdoor section 10 is comprised of a flat top 74 and four planar, angled, louvered sides 76, 78, 80 and 82. The louvered sides and the flat top are connected by end pieces 84. Flat top 74 overlies top cover 16 and the louvers 18 therein. Therefore, it is virtually impossible for debris or the elements to enter lower cabinet section 14 from above. Disposed interior of outdoor section 10 is a stator 86 which consists of diagonally running vertical walls 88, 90, 92 and 94. Stator 86 both provides structural support for flat top 74 and assists in the deflection and direction of the air which passes through top louvers 18 of top cover 16 into the interior of upper cabinet section 14 toward angled sides 76, 78, 80 and 82. Stator 86 cooperates with the upper cabinet section sides and top and the lower cabinet section cover to define discrete air discharge chambers 96, 98, 100 and 102 associated one each with an upper cabinet section side.

Figure 6:
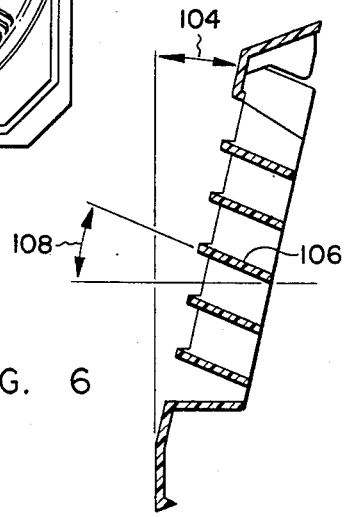
FIG. 6 is a cross-sectional view of a typical upper cabinet section side.

Sides 76, 78, 80 and 82 of the upper cabinet section are angled up to 45 degrees from the vertical, as is best illustrated at 104 in FIG. 6. Likewise, louvers 106 are angled from the horizontal, for airflow efficiency, as is illustrated at angle 108 in the same Figure at an angle of from 10 to 45 degrees inclusive. The larger the louver angle of the upper cabinet sides the less are the airflow losses and the less is the recirculation of air through the heat exchanger coil. Upper cabinet section 14 can be attached to lower cabinet section 12 in any number of ways but preferably is retained in place by spring clips or the like so that upper cabinet section 14 may be snapped off of lower section 12 without the removal of any fasteners or the use of any tools.

It should be apparent that the angular disposition of lower cabinet section side panel louvers 44, top cover louvers 18, louvers 106 in the sides of upper cabinet section 14 and the angle of sides 76, 78, 80 and 82 of upper cabinet section 14 are critical to minimizing airflow losses through outdoor section 10. The cooperation of the lower cabinet section side louvers, the angled lower section top cover louvers, stator 86 and the angled sides and louvers of upper cabinet section 14 results in efficient airflow and heat exchange in a cabinet which additionally provides the advantages of an outdoor section which protects the components housed internal of it.

Lower cabinet section 12 includes a refrigerant fittings panel 110 which provides a convenient point of connection for the refrigerant piping that connects the outdoor heat exchanger section 10 to the indoor heat exchanger coil which is not shown. Panel 110 provides a fitting mounting surface 112 which is in a plane parallel to one of the cabinet sides so that little or no bending of refrigerant piping is necessary to hook up the outdoor cabinet section which will normally be installed such that at least one of its sides is parallel to the structure alongside of which it is disposed.

As earlier noted, outdoor cabinet section 10 is preferably rectangular as is coil 20 which wraps around the inside wall of the lower cabinet section. The ends of the individual heat exchanger coil circuits are preferably angularly disposed downward and outward from the space defined interior of the coil. The circuit ends, of which plumbing connection 58 is typical, and refrigerant plumbing which connects the individual circuit ends to the refrigerant fittings on panel 110 are all disposed for easy access in the space beneath control compartment 56 between the heat exchanger coil and access panel 48. It will be noted that coil 20 is physically more remote from access panel 48 than it is from the remainder of the lower cabinet side wall portions. An easily accessible space for refrigerant plumbing and controls is thereby created.

While cooperating with the remainder of outdoor section 10 to provide an accessible and protected space for refrigerant plumbing and system controls, access panel 48, which as previously mentioned is louvered, provides additional access for air to be drawn into the lower cabinet section and over heat exchanger coil 20. Therefore, the heat exchanger coil can be located around the entire periphery of the cabinet, resulting in the maximum exposure of heat transfer surface to air flow and in increased system efficiency. The routing of refrigerant plumbing to and from the compressor may be accomplished by providing a dedicated depression in the base pad which passes underneath the heat exchanger coil.

Although the air conditioning outdoor section of the present invention has been illustrated and described in terms of a four-sided cabinet it will appreciated that the objects of the present invention are capable of being achieved in a cabinet having more or fewer sides. Therefore, the scope of the invention is to be limited only by the language of the claims which follow.

What is claimed is:

1. An outdoor section for an air conditioning system comprising:

a compressor;

a heat exchanger;

a cabinet having an upper cabinet section, a lower cabinet section and a louvered lower section top cover, said heat exchanger and said compressor being housed in said lower cabinet section and said upper cabinet section having a solid top which overlies the louvers in said lower section top cover; and a fan disposed in said lower cabinet section to draw air through the sides of said lower cabinet section and through the heat exchanger housed therein, said fan discharging air, after having been drawn through said heat exchanger, upward through the louvers in said lower cabinet section top cover and into the interior of said upper cabinet section.

2. The outdoor section according to claim 1 wherein said upper cabinet section has louvered sides disposed about its periphery.

3. The outdoor section according to claim 2 wherein the solid top of said upper cabinet section is essentially flat.

4. The outdoor section according to claim 2 wherein said louvers in said upper cabinet section sides are angled to promote the discharge of air from the interior of said upper cabinet section in a direction which is upward and away from said lower cabinet section.

5. The outdoor section according to claim 4 wherein said upper cabinet section sides are angled to further promote the discharge of air from the interior of said upper cabinet section in a direction which is upward and away from said lower cabinet section.

6. The outdoor section according to claim 5 wherein said louvers in said upper cabinet section sides are angled from the horizontal at an angle in the range of from 10° to 45° inclusive and wherein said sides of said upper cabinet section are angled from the vertical at an angle of up to and including 50°.

7. The outdoor section according to claim 6 wherein said lower cabinet section has louvers disposed about its periphery which open upward into the interior of the lower cabinet section, said louvers imparting a vertical velocity vector to the air which is drawn to the sides of the lower cabinet section by the operation of said fan.

8. The outdoor section according to claim 6 wherein said louvers in said lower section top cover are angled from the vertical at an angle in the range of from 15° to 35° inclusive.

9. The outdoor section according to claim 6 further comprising a stator mounted interior of said upper cabinet section for supporting the top of said upper cabinet section and for directing air out of the interior of said upper cabinet section to the louvered upper cabinet section sides.

10. The outdoor section according to claim 9 wherein said stator is comprised of a plurality of vertical wall portions extending generally from the center of the louvered portion of said lower section top cover, there being one wall portion for each louvered upper cabinet section side, said well portions cooperating with each other, the sides and top of said upper cabinet section and said lower section top cover to define discrete air discharge chambers interior of said upper cabinet section, there being one air discharge chamber for each upper cabinet section side.

11. The outdoor section according to claim 10 wherein said lower cabinet section, said upper cabinet section and said heat exchanger all have four sides, said heat exchanger extending around the inner periphery of said lower cabinet section, one side of said heat exchanger being spaced from one of said lower cabinet section sides to define a space wherein refrigerant plumbing connections, controls and the like are disposed, the one of said lower cabinet section sides said heat exchanger is spaced from being a removable side to give access to said space.

12. The outdoor section according to claim 11 wherein the corners of said lower cabinet section are beveled to provide rigidity and strength in said outdoor section.

13. An air conditioning outdoor cabinet section comprising:

a lower cabinet section through which air is drawn into said outdoor section;

a louvered lower section top cover overlying said lower cabinet section, air drawn into said lower cabinet section being discharged therefrom through the louvers in said lower section top cover;

an upper cabinet section having a solid top and peripheral louvered sides, said solid top overlying at least the louvers in said lower section top cover, said sides being angled from the vertical at an angle of up to and including 45° and said louvers in said sides being angled from the horizontal at an angle in the range of from 10° to 45° inclusive; and a stator disposed in said upper cabinet section, said stator both providing support for said solid upper cabinet section top and selectively directing air discharged from said lower cabinet section into said upper cabinet section through said lower section top cover louvers to the sides of said upper cabinet section.

14. The outdoor section according to claim 13 wherein the louvers of said lower section top cover are angled from the vertical at an angle in the range of from 15° to 35° inclusive to impart a horizontal velocity vector to air passing upwardly therethrough.

15. The outdoor cabinet section according to claim 14 wherein said stator cooperates with said upper cabinet section and said lower section top cover to define a plurality of air discharge chambers in said upper cabinet section, there being one air discharge chamber associated with each louvered side of said upper cabinet section.

16. The outdoor cabinet section according to claim 15 wherein the sides of said lower cabinet section each define a plurality of upward opening louvers for imparting a vertical velocity vector to air entering said lower cabinet section sides.

17. The outdoor cabinet section according to claim 15 wherein the solid top of said upper cabinet section is flat.

* * * * *